US005875664A

United States Patent [19]

Scott et al.

[11] Patent Number: 5,875,664

[45] Date of Patent: Mar. 2, 1999

[54] PROGRAMMABLE SERVO-MOTOR QUALITY CONTROLLED CONTINUOUS MULTIPLE COIL SPRING FORMING METHOD AND APPARATUS

[75] Inventors: Terence A. Scott, Reading, England; Henry G. Mohr, Carthage, Mo.

[73] Assignee: L&P Property Management Company, South Gate, Calif.

[21] Appl. No.: 997,598

[22] Filed: Dec. 23, 1997

[51] Int. Cl.[6] ..... B21B 37/02; B21B 37/08; B21F 3/02

[52] U.S. Cl. ..... 72/16.1; 72/19.8; 72/135; 72/138

[58] Field of Search ..... 72/16.1, 16.2, 72/17.3, 18.1, 18.2, 19.2, 21.1, 135, 138, 132

[56] References Cited

U.S. PATENT DOCUMENTS

| | | | |
|---|---|---|---|
| 4,112,721 | 9/1978 | Takase et al. . | |
| 4,444,036 | 4/1984 | Shibata . | |
| 4,669,289 | 6/1987 | Itaya . | |
| 4,672,549 | 6/1987 | Saxton . | |
| 4,873,854 | 10/1989 | Russell et al. . | |
| 4,991,277 | 2/1991 | Itaya . | |
| 5,259,226 | 11/1993 | Itaya | 72/138 |

FOREIGN PATENT DOCUMENTS

| | | |
|---|---|---|
| 937644 | 9/1963 | United Kingdom . |
| 1095980 | 12/1967 | United Kingdom . |
| 1104884 | 3/1968 | United Kingdom . |
| 1181007 | 2/1970 | United Kingdom . |
| 1182414 | 3/1970 | United Kingdom . |
| 1183315 | 4/1970 | United Kingdom . |
| 1207717 | 7/1970 | United Kingdom . |
| 1235669 | 6/1971 | United Kingdom . |
| 1245033 | 9/1971 | United Kingdom . |
| 1327795 | 8/1973 | United Kingdom . |
| 1399811 | 7/1975 | United Kingdom . |
| 1522611 | 8/1978 | United Kingdom . |
| 2143731 | 11/1986 | United Kingdom . |

*Primary Examiner*—Joseph J. Hail, III
*Assistant Examiner*—Rodney Butler
*Attorney, Agent, or Firm*—Wood, Herron & Evans, L.L.P.

[57] ABSTRACT

A spring forming machine is provided with closed-loop feedback from sensors which monitor dimensions of the coils and heads of the spring being formed, servo motors which control wire feed speed, coil radius and pitch forming elements, and coiling direction. Video cameras form pictorial images of the spring being formed. The images are digitized and fed to a central computer, along with images from similar machines forming similar springs, which compares the signals, such as photometric images, from the different machines, which represent actual spring dimensions, with a single stored image relating to the desired dimensions, such as head shape, coil diameter, and the positions and angles of bends. Discrepancies are correlated with causation data, such as feed roll slippage or material hardness variations, and adjustment signals are sent to the machines. Machines producing errors are interrogated more frequently by the computer. Large errors or failures to respond to adjustments triggers an alarm.

26 Claims, 3 Drawing Sheets

PROGRAMMABLE SERVO-MOTOR QUALITY CONTROLLED CONTINUOUS MULTIPLE COIL SPRING FORMING METHOD AND APPARATUS

The present invention relates to the manufacture of coil springs, particularly continuous multiple coil springs, and, more particularly, to the control of coil forming machines to maintain consistently, or to vary programmably, the dimensions and other properties of coils formed thereby.

BACKGROUND OF THE INVENTION

Machines for forming coil springs from continuous wire are well known in the prior art. In the manufacture of mattresses and upholstered furniture that use arrays of coil springs, machines have been employed in the prior art that form a plurality of springs from a continuous length of wire. One such machine is disclosed in British Patent No. 1,327,795 to Willi Gerstorfer entitled "Improvements in or relating to Machines for the Manufacture of Compression Spring Strips from Wire, for example for Upholstery Inserts," expressly incorporated herein by reference. The machine of the Gerstorfer patent is operative to manufacture from a continuous length of wire a plurality of interconnected compression springs comprising alternate left and right hand coil springs joined by an integral straight length of wire. The machine of the Gerstorfer patent employs moveable linkages to shift the settings of the machine to coil the continuous wire alternately in first one direction and then the other, with each coiling direction being followed by the feeding of a length of straight wire. The linkages are cam controlled, with the cam shapes determining the pitch and radius of each spring coil and the length of each straight section of wire interconnecting the coils.

In the use of the machine described in the Gerstorfer patent, however, variations in the dimensions and metallurgical properties of the wire affect the dimensions and elastic properties of the coils formed of the wire, causing the spring dimensions to vary from spring to spring and from one coil to another. This variation can be reduced with wire of higher quality and price. In many applications, there is no need to control precisely the quality of the produced springs because the quality of the mattress or upholstery item in which they are used is not materially altered thereby, or because variations in the parameters of the springs can be compensated in assembly done by hand.

With the increased use of robotics and automated assembly of products using coil springs of the type referred to above, variations in the tolerances of the springs, which may be acceptable from the point of view of the quality of the final product, may not be tolerable for use in the automated assembly machinery that tends to rely on the components being in predictable locations and of predictable dimensions. This is particularly true of the relatively rigid straight lengths of wire which interconnect the elastic coils. Thus, there is a need for coil forming machines to accommodate variations in the quality of the wire from which coil springs are formed and variations in other parameters that cause variations in the dimensions or other properties of the manufactured springs, notwithstanding the precise repeatable movement of the coil forming machine elements.

In addition, in the coil forming machines of the prior art, such as those of the Gerstorfer apparatus referred to above, changes in the dimensions or other specifications of the springs being produced requires replacement or readjustment of mechanical machine components. Such a major changeover in the machine configuration, which replacement or readjustment of machine components entails, is time consuming, limits the flexibility of the machine, and adds cost to the use of the machinery for the manufacture of springs of differing specifications. Accordingly, there is a need for a spring forming machine that can more flexibly accommodate the manufacture of springs of differing designs.

SUMMARY OF THE INVENTION

It is a primary objective of the present invention to provide a coil forming machine that will maintain consistent dimensions of springs manufactured thereby. In particular, such dimensions are precisely maintained notwithstanding changes in factors, such as the dimensions or material properties of the wire that cause the coils to form differently with the same settings of the wire forming machine.

It is a more particular objective of the present invention to provide a control for a coil forming machine, and a method of forming a coil thereby, that will maintain desired coil dimensions with on-line measurement of the produced spring and provide real-time variation of the machine settings to compensate for any tendency of varying wire properties to cause variations in the dimensions of the formed springs.

It is an additional objective of the present invention to provide a coil forming machine and control therefor that is readily changeable to easily and rapidly accommodate changes in coil specifications and overall spring design.

It is a further objective of the present invention to improve quality control, reduce control system cost, and facilitate operator usage of a plurality of spring making machines for producing a common product.

In accordance with the principles of the present invention, there is provided a coil forming machine with servo controlled wire bending elements positioned and moved in response to on-line measurements of shapes of the springs being formed. In accordance with the preferred embodiment of the present invention, a servo controlled coil forming apparatus is provided, which senses and responds to the shape of the coil being formed. The sensing preferably employs a photometric technique, or other measurement technique known in the manufacturing machine control art, together with pictorial computer analysis, or other automated measurement interpretation method, to resolve the actual dimensions and shape of the spring being produced. Comparison of the measured dimensions with desired spring shape criteria stored in memory is used to make compensating adjustments to the positions and motions of the machine elements that determine the shapes and properties of the coils being produced.

Further in accordance with the present invention, a coil forming machine is provided with the capability of accepting a programmed form of the intended design of the spring product and to set the machine to make springs of various designs without the need to mechanically adjust the machine. Spring designs may be input in the form of electronically input and magnetically stored data, a mechanical or pictorial template in one or several dimensions, or some other form of a reference design representation, which is then compared with the measured data from the operation of the manufacturing process to generate an error signal that continually varies the settings of the machine, causing any of a variety of programmed designs to be produced.

In addition, in some embodiments of the invention, intermittent sampling of spring shape is employed. In certain of such embodiments, a single control system, preferably equipped with a computer, is employed to analyze and control several spring forming machines. With such a computer, the changing of the designs for a plurality of machines, such as where they all are to be set up to produce the same product, can be accomplished with a single operator action. Improved quality control is accomplished by comparing data from all of the machines with a single image. Sensed discrepancies are correlated with stored data to determine the cause and corrective adjustment signals are sent to the appropriate machine. The machines that produce more errors than other machines are more frequently sampled. The computer may also control process functions, such as intermittent cutoffs of strands of multiple coils in predetermined coil numbers.

As a result of the present invention, a coil forming machine and control therefor are provided, which maintains the quality of springs being produced through in-line measurement and real-time variation of machine settings as the spring products are being formed. As a result, compensation for variations in conditions, such as material properties, over the course of manufacture of a series of springs or of a single spring, is made by almost instantaneous machine element adjustment.

Also as a result of the present invention, springs of complex and varying designs can be made without changing or adjusting the mechanical components of the spring forming machine, and immediate changeovers from one spring design to another can be made quickly or automatically.

These and other objectives and advantages of the present invention will be more readily apparent from the following detailed description of the drawings.

DETAILED DESCRIPTION OF THE DRAWINGS

Figure 1:
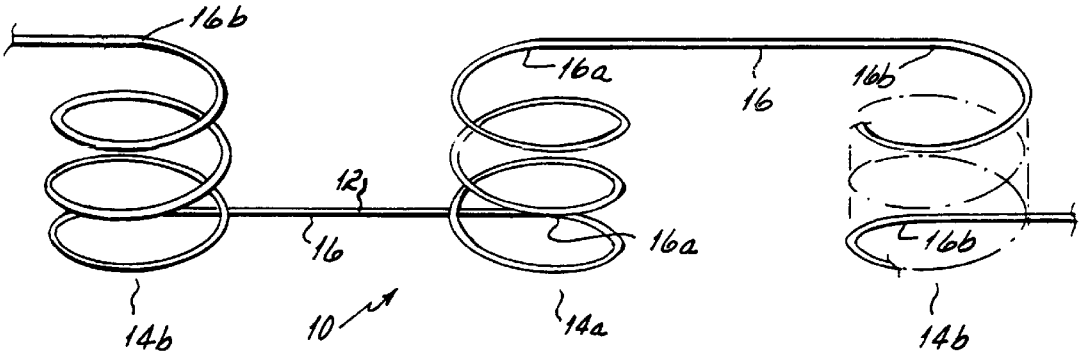
FIG. 1 is a perspective view of an example of a coil spring formed by a coil forming apparatus.

FIG. 1 illustrates a coil spring 10, which is one example of the type of spring that is particularly suited for manufacture on apparatus of the type to which the present invention relates. The spring 10 is formed of a continuous length of wire 12 into a series of coils 14 that include alternating left and right hand coils, such as left hand coil 14*a* and right hand coil 14*b*, interconnected by straight sections 16 of the wire 12.

In the prior art, springs such as spring 10 of FIG. 1 have been manufactured on machines like those described in the Gerstorfer British patent No. 937,664 incorporated by reference. Such a machine is represented diagrammatically in FIG. 2.

Figure 2:
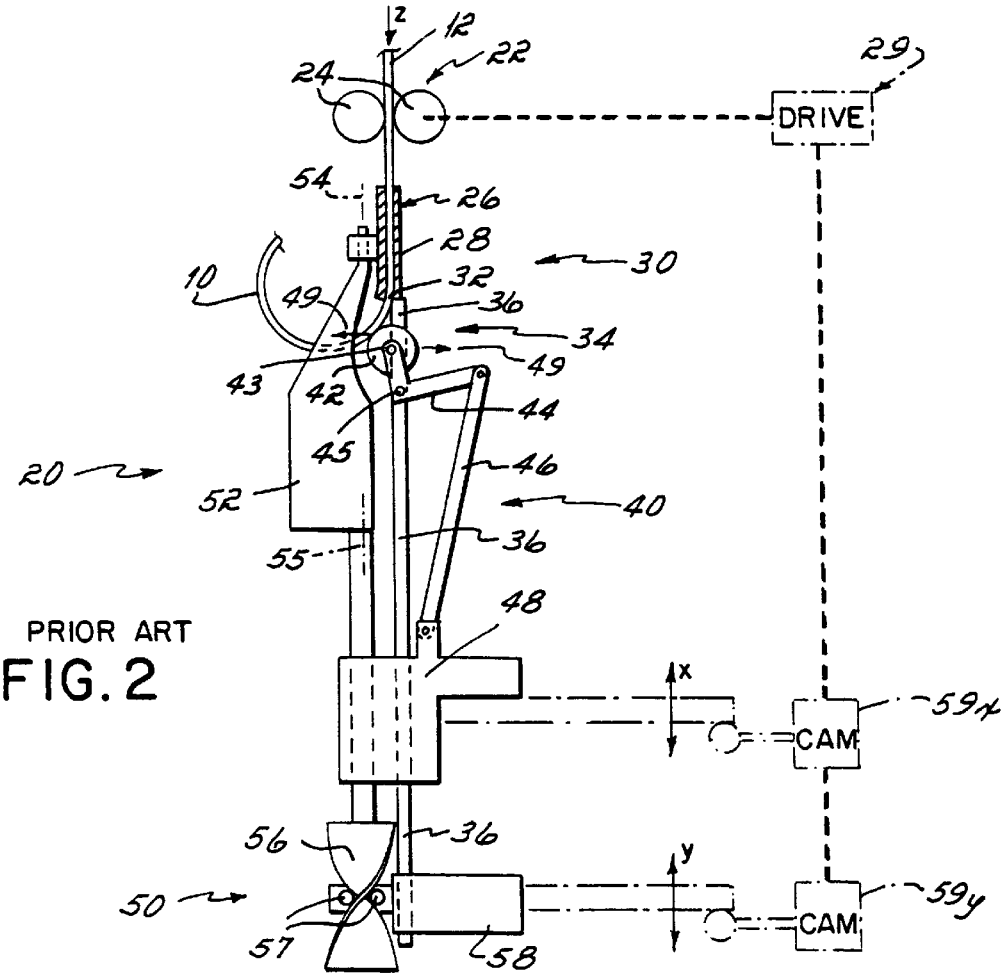
PRIOR ART FIG. 2
FIG. 2 is a diagrammatic drawing of a spring forming apparatus of the prior art.

Referring to FIG. 2, a spring forming apparatus 20, according to the prior art, is provided with a wire feed mechanism 22, which includes a pair of feed rollers 24 to advance the wire 12 longitudinally in a linear direction z through a channel 26 formed in a wire guide 28 of a forming head 30. The wire 12 emerges from the channel 26 of the forming head 30 at an orifice 32 where it is shaped into the form of the spring 10 by a spring forming mechanism 34, which bends the wire 12 to deform plastically and thereby permanently shape it to that of the desired spring design, as for example the design of the spring 10 of FIG. 1.

The spring forming mechanism 34 is mounted on a shaft 36, which is rigidly attached to the guide 28 of the forming head 30. The shaft 36 and the forming head 30 are rotatable on a frame (not shown), as described in the Gerstorfer patent. Accordingly, the shaft 36, for purposes of the present invention, may be considered fixed.

The forming mechanism 34 includes a coiling radius forming section 40, which bends the wire 12 into an arc lying in the transverse plane of the coils 14 of the spring 10 and a coil pitch forming section 50, which bends the wire 12 in a direction axial to the coils 14 of the spring 10.

The coil forming section 40 includes a forming roll 42 having a groove in the edge thereof to guide the wire 12 as it emerges from the orifice 32 of the head 30 and deflects the wire 12 in the plane of the roll 42. The roll 42 is rotatably mounted about an axis 43 perpendicular to the plane of the roll 42 on an L-shaped lever 44. The lever 44 is in turn pivotally mounted at the angle of the L, to the shaft 36 to pivot about an axis 45 parallel to the axis 43. The end of one leg of the L of the lever 44 is pivotally linked to one end of a rod 46. The rod 46 is pivotally linked at its other end to a block 48, which is slidably mounted on the shaft 36 to slide longitudinally therealong. The linkage that includes the block 48, the rod 46, the lever 44 and the roll 42 translates linear movement of the block 48, represented by the variable x, into deflection of the roller 42 in the direction represented by the arrow 49 to bend the wire 12 into a desired radius.

The coil pitch forming section 50 of the coil forming mechanism 34 includes a pocket 52 formed of a pair of identical parallel plates spaced from each other a distance slightly larger than the thickness of the wire 12. The plates of the pocket 52 are joined at their upper ends and pivotally attached to the head 30 at an axis 54, which is parallel to the shaft 36. The plates of the pocket 52 are also joined and pivotally mounted at their lower ends on an extension 55 of the axis 54 and parallel to the shaft 36. The pocket 52 is thereby rotatable on the axes 54, 55. Rigidly extending from the pocket 52 on the axes 54,55 is a helical cam 56. A pair of rollers 57 on a block 58, which is slidably mounted on the shaft 36, engage the cam 56 on both sides thereof to rotate the pocket 52 as the block 58 moves axially on the shaft 36 a linear dimension represented by the variable y. The mechanism 50 thereby translates the linear motion of the block 58 in the direction y to rotating motion of the pocket 52, which results in a bending of the wire 12 in the longitudinal direction of the coil 14 of the spring 10 to impart pitch to the coil. The sign of the variable y reflects the direction (left hand or right hand) of the formed coil.

The shape of the spring that is formed by the device 20 is determined by the respective relative motions x and y of the blocks 48 and 58 with respect to the feed z of the wire 12. This motion is controlled by the shapes of cams 59*x* and 59*y*, respectively, which are linked to and driven by a drive mechanism 29 of the wire feeder 22.

In order to accommodate a change of direction of the bend of the wire 12 into a coil radius of opposite rotational direction or hand by the roller 42, the shaft 36 and all components thereon is rotatable through an angle of 180°.

Figure 3:
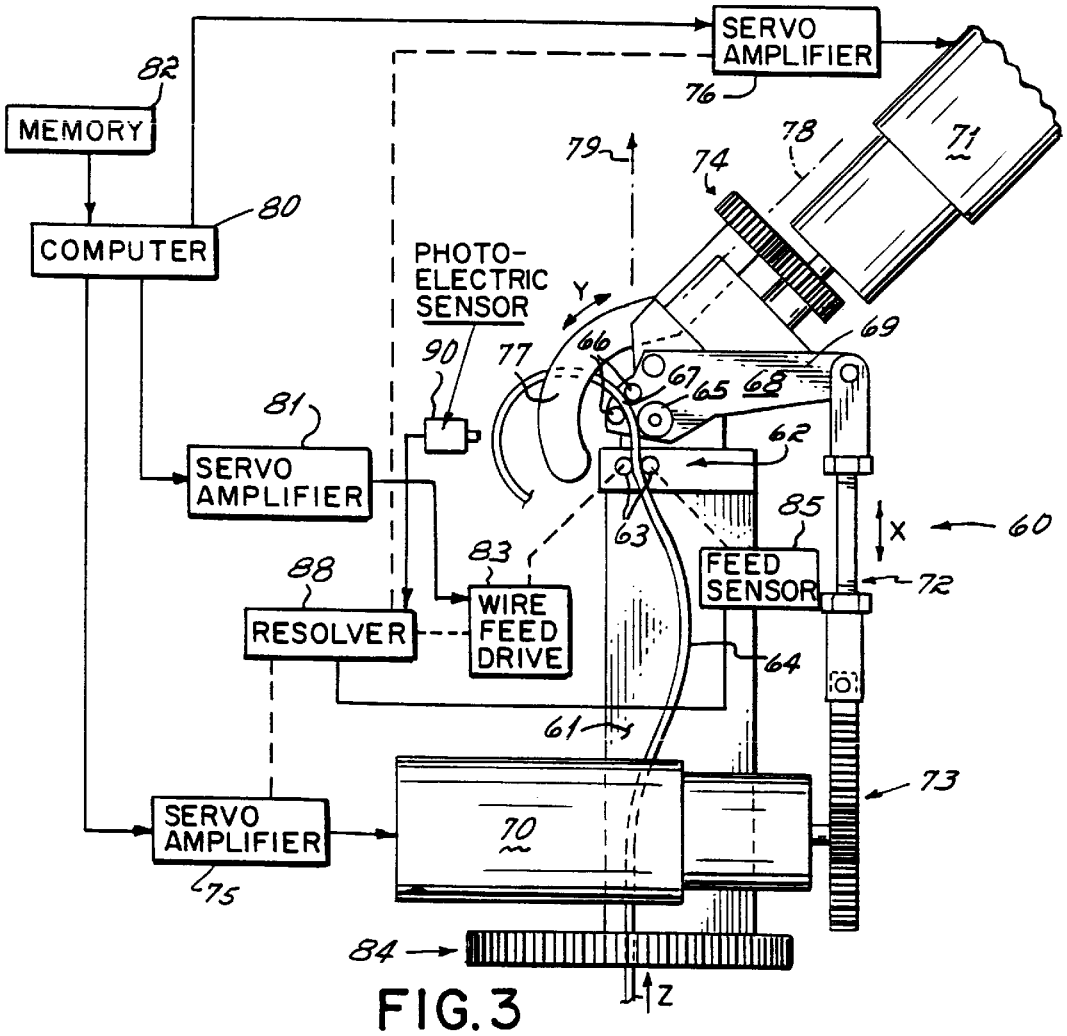
FIG. 3 is a side elevational diagrammatic drawing of a coil forming apparatus according to principles of the present invention.

FIG. 3 diagrammatically illustrates one embodiment 60 of a wire forming device of the present invention. The wire forming device 60 includes a frame or housing 61 to which is mounted a wire feeder 62, which includes a pair of rollers 63 for feeding the wire 12 a controlled longitudinal amount, represented by the variable Z, which is equivalent to the variable z of FIG. 1. The wire 12 is fed in such a way as to cause a bow 64 to form in wire 12 to inhibit the inclination of the wire 12 to rotate about its axis of feed.

From the feeder 62 the wire proceeds over a fixed roller 65 rotatably mounted to the housing 61 and then through the nip 67 of a pair of moveable rollers 66 rotatably mounted on a plate 68 which is pivotally mounted to the frame 61 at the axis of the roller 65. The plate 68 has an end which constitutes as a lever 69, which moves in a direction represented by a variable X. The lever 69 is driven in the X direction by a servo motor 70 mounted to the housing 61 and linked to the lever 69 through linkage 72. The servo motor 70 is preferably a rotary stepping motor, but may be another type of feedback responsive actuator, which drives the linkage 72 through a rack and pinion drive 73. The variable X thus controls the radius of the coil of the wire 12 being formed.

A similar second servo motor or actuator 71 is also mounted to the frame 61 and has an output connected through gears 74 to a fork or pocket 77 through which the wire 12 enters after passing the rollers 65 and 66. Rotation of gears 74 pivots the pocket 77 about an axis 78 to bend the wire 12, imparting a pitch to the formed coil. The motion of the pocket 77 is represented by the variable Y.

When the moveable rollers 66 are in alignment with the path of the wire 12 that is tangent to the fixed roller 65, and when the pocket 77 is centered, the wire 12 advances in the longitudinal direction Z to assume a straight shape along the line 79 in FIG. 3.

In the position illustrated in FIG. 3, the moveable rollers 66 and the pocket 77 are displaced in accordance with the variables X and Y as controlled by the actuators 70 and 71. The movement of the moveable rollers 66, caused by movement of the lever 69 and linkage 72 in the direction X by the servo 70, increases the tightness of the curvature of the turns of the coil 14 of the spring 10. The rotation of the pocket 77 in the direction Y about the axis 78 increases the pitch of the coil 14 of the spring 10.

The actuators 70 and 71 are driven by the outputs of servo amplifiers 75 and 76 respectively. The output signals from the servo amplifiers 75 and 76 control the motors 70 and 71 to cause the displacement X of the rollers 66 and the displacement Y of the pocket 77 to conform to programmed or otherwise predetermined functions X(Z) and Y(Z), respectively, of the wire feed Z. The wire feed Z is in turn driven by an actuator 83 and controlled to conform to a function of time Z(t) by a servo amplifier 81. The functions Z(t), X(Z) and Y(Z) are programmed values controlled by a computer 80 under the control of a program stored in a programmable memory or medium 82. In this way, the position of the rollers 66 is controlled as a function of the wire feed Z(t) so that the formed spring 10 may assume the shape of that of FIG. 1 or of some other desirable shape. The shape also may be changed by reprogramming or entry of new parameters into the computer 80 or may change according to preprogrammed parameters to, for example, produce a product with a plurality of coils of differing properties or to change from one coil type to another according to some predetermined schedule.

In order to accommodate a change of direction of the bend of the wire 12 into a coil radius by the rollers 66, the housing 61 with all components thereon, is rotatable through an angle of 180° by rotation of a geared support plate 84, which is driven by another servo motor or other actuator (not shown in FIG. 3).

In one embodiment of the invention, the apparatus 60 of FIG. 3 is configured to provide real-time adjustment of the parameters X and Y to control the quality of the springs 10 as they are being formed. The device 60 is provided with a wire feed sensor 85, which measures the actual linear feed of the wire 12 and generates a signal to a resolver 88. In addition, a photometric sensor 90 is also provided, which senses the position and shape of the spring 10 being formed and emerging from the moveable rollers 66 to generate a signal to the resolver 88. The resolver 88 generates signals representative of the actual displacements $X_A$ and $Y_A$ of the forming spring 10, and of the actual linear feed $Z_A$ of the wire 12. These signals are fed to the differential servo amplifiers 75, 76 and 77, respectively, where they are compared with programmed values to produce error signals. The error signals drive the stepping motors 70 and 71 to vary the X-Y positions of the rollers 66 and the pocket 77, respectively, and to control the feed motor 83 to control the feed Z of the wire 12.

An important advantage of the control of the variables X and Y of FIG. 3 is to shape precisely the more rigid straight section 16 (FIG. 1) of the spring 10, particularly by controlling its length and the bends 16*a* and 16*b* joining the straight sections 16 to the coils 14*a* and 14*b* respectively. With such precise control, accurate automated handling of the spring units of a multiple coil spring assembly is facilitated. One configuration of the control scheme of the apparatus which provides this advantage is illustrated in FIG. 4.

Figure 4:
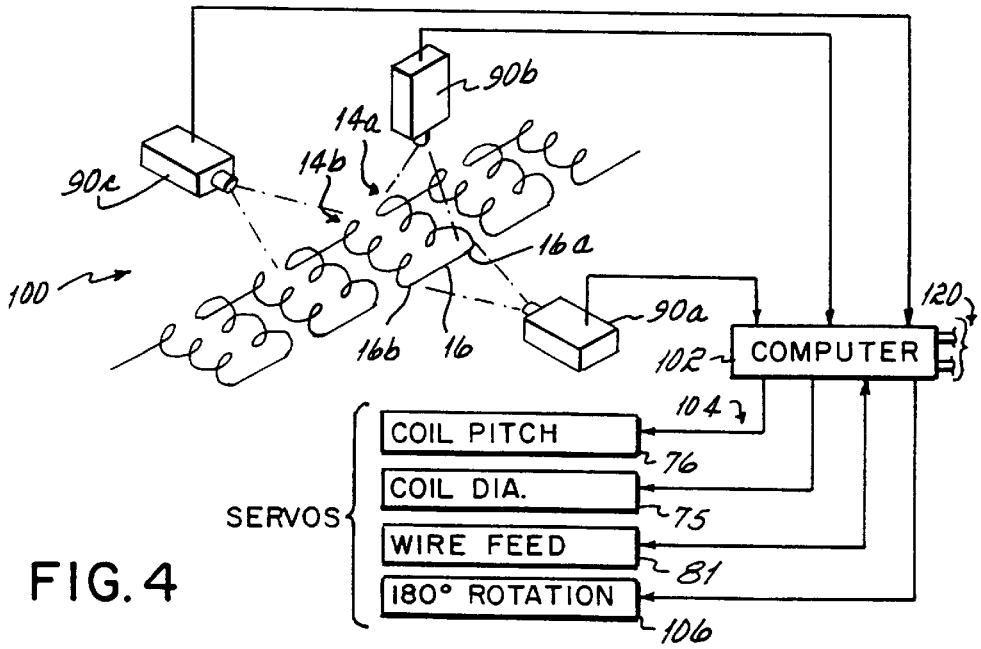
FIG. 4 is a block diagram of the feedback control according to one embodiment of the apparatus of FIG. 3.

Referring to FIG. 4, the formed spring 10 is monitored downstream of the forming device 60 of FIG. 3 with a vision feedback and measurement system 100. The system 100 includes a plurality of sensors in the form of video cameras 90*a*, 90*b* and 90*c*. The camera 90*a* is positioned to form a television image of one of the heads of the spring 10 to capture the precise length and curvature of the wire 12 which forms the straight length 16 and bends 16*a* and 16*b*. The camera 90*b* is positioned at a 90° angle to the camera 90*a* to generate alternate separate pictorial images of the left and right hand coils 14*a* and 14*b* as they pass the camera 90*b*. The camera 90*c* is positioned to form an image of the spring head opposite that monitored by camera 90*a*.

The outputs of the cameras 90*a*–90*c* are connected to a computer 102 which performs functions similar to those of the computer 80, the memory 82 and the resolver 88 of FIG. 3. The computer 102 is programmed with software which digitizes the images from the cameras 90*a*–90*c* and compares the digitized images with digitized standard images of the desired shape of the spring to produce error signals for delivery to the servos. Suitable hardware and software is available in several forms including, for example, those sold under the trademarks "AdeptVision AGS" system with "AdeptMotion Servo" board, "V+" system software and "VisionWare" application development software by Adept Technology, Inc. of San Jose, Calif.

The computer 102 has control lines 104 which deliver signals to the wire feed servo amplifier 81, the coil diameter servo amplifier 75 and the coil pitch servo amplifier 76. In addition the computer 102 has an output line connected to a servo motor 106 which controls the 180° positioning of the forming head 60 to switch between the orientations for formation of the alternate left and right hand coils 14*a* and 14*b*. The 180° position of the head 60 is correlated in the computer 102 with the outputs of the cameras 90*a* and 90*c* to coordinate the interpretation of the images from the cameras 90*a* and 90*c* with the appropriate head of the spring. Similarly, interpretation of the image from the camera 90*b* with respect to left or right hand coil direction is also coordinated with the information as to the position of the head 60.

In certain embodiments, a system is provided in which a single computer 102 is part of a common control system which controls a plurality of spring forming machines. Such a computer 102 is provided with a plurality of cables 120 each containing signal lines connected to cameras such as cameras 90*a–c* and servos such as servos 75, 76, 81 and 106 of other forming machines.

Figure 5:
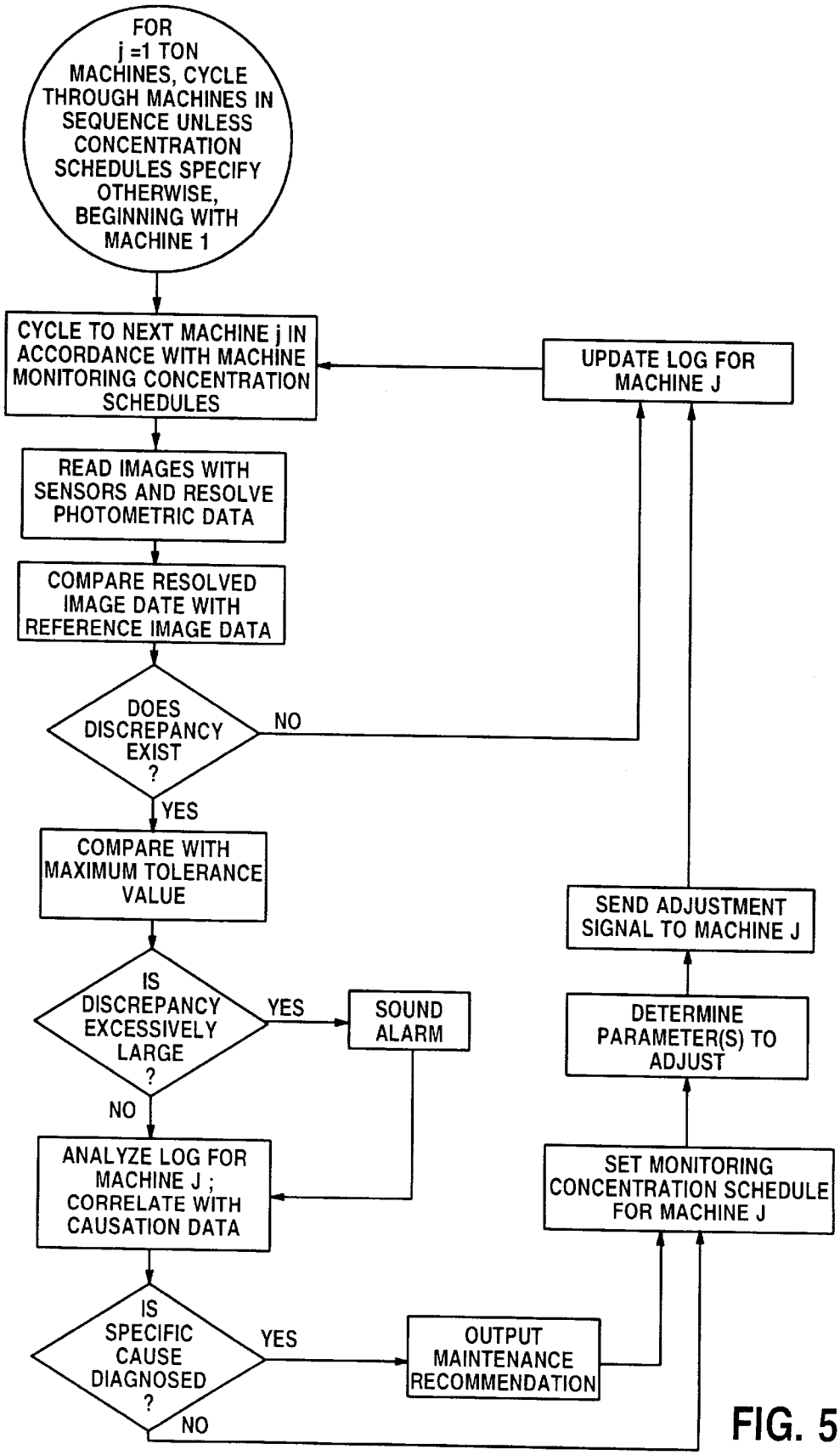
FIG. 5 is a flow chart of one embodiment of a control program useful in the computer of the system of FIG. 4.

Referring to FIG. 4 and the flowchart of FIG. 5, in the operation of a multimachine system, the computer 102 receives signals on the lines 120 from each of a plurality of spring forming machines 60. On each of the lines 120 from the machines 60, video image signals, which may be in analog form, appear constantly on inputs of the computer 102, which may be on terminals of video boards in the computer 102 or through a piece of peripheral equipment. Initially, the computer 102 steps through a sequence that indexes a sampling of the inputs from the various machines in some predetermined order, for example, sampling machine j and j steps from 1 to N machines.

When the input image is sampled for the current machine j, the image is digitized and converted into photometric data with conventional software that will define the image in terms of selected parameters. The converted photometric data is then compared with a photometric standard stored in the memory of the computer, which will be the same for all of the machines N that are producing the same part. If machines producing different parts are connected to the same computer 102, groups of machines N, M, etc. are processed separately. As a result of the comparison, a determination is made by the execution of software routines of whether or not a discrepancy exists. A discrepancy may be an out of tolerance coil radius, coil pitch, coil head dimension, wire orientation at a predetermined point on the formed spring or wire position at a predetermined point along its length.

If, according to the programmed criteria, no discrepancy is determined to exist, a log entry is generated for a particular coil made on the machine j, along with other recorded data that may aid in future analysis. If a discrepancy is determined to exist, the out of tolerance values that are calculated from the measurements and compared standard data are further compared with maximum allowable values. If, as a result of this further comparison, the discrepancies are determined to be excessive, an alarm is sounded or some other equivalent action is taken to alert an operator so that special corrective action, if indicated, can be taken.

Following determination of the existence of a discrepancy, further analysis is made by the computer 102 of the discrepancy in the context of the log for the machine j. The analyzed information is correlated with discrepancies and discrepancy trends for which causes are known. For example, where repeatedly large diameter coils are observed to result from settings that, historically, produce smaller diameter coils, a conclusion may be reached that the stiffness of the particular batch of wire is greater than normal. Also, where the lengths of straight sections of wire forming a coil head are shorter than expected, the conclusion may be reached that wire feed rolls have worn and are slipping. Other observed discrepancies or discrepancy trends may be correlated with stored data to arrive at conclusions pointing to other causes. When such a diagnosis can be made that is best corrected by maintenance beyond the automated adjustments of the machine, a maintenance recommendation is generated by way of the computer output.

Whether or not a specific cause is diagnosed, the existence of a discrepancy in a coil formed on the machine j is an indication that a discrepancy is more likely to occur in the next coil formed by the same machine than on a machine in which no discrepancy has occurred. Therefore, the monitoring schedule for the machines 1 through N is altered so that the machine j is sampled more frequently. Such a monitoring concentration schedule is adjusted after the computer 102 checks all of the logged date for all of the machines, to thereby distribute the sampling frequency among the machines in accordance with a priority based on the need for monitoring of the respective machines.

The last step in the analysis is the determination of what, if any, parameter adjustments must be made, including the determination of the parameter which, if adjusted, will tend to reduce the discrepancy, and the amount of adjustment that must be made. Then, a control signal is generated and communicated to the machine j along one of the control lines 103 to the machine j, to effectuate the adjustment. Then the log for the machine j is updated to record the measurements and the corrective action made. Then, the computer 102 indexes to the next machine to be monitored, which may be the machine j+1, or a repetition of machine j or an advance to another machine, all in accordance with the concentration schedules of the machines.

The invention has been disclosed in the context of certain preferred embodiments. Those skilled in the will appreciate that other variations of these embodiments would provide the advantages of the invention without departing from its principles.

What is claimed is:

1. A method of forming a continuous multiple coil spring having a plurality of alternately oppositely oriented coils joined by interconnecting heads, the method comprising the steps of:

(a) storing spring head shape information related to a programmed shape of a head for interconnecting an adjacent pair of coils to be formed of a wire;

(b) feeding a wire at a controlled linear rate, and, while so feeding the wire:

generating a coil radius electrical control signal related to a programmed radius of coils to be formed of the wire, generating a coil pitch electrical control signal related to a programmed pitch of coils to be formed of the wire, and bending the wire to the programmed radius in response to the coil radius electrical control signal and to a programmed pitch in response to the coil pitch electrical control signal;

to thereby form a first coil therein having a first orientation;

(c) further feeding the wire at a controlled rate, and, while so feeding the wire, guiding the wire, in response to a head shape electrical control signal responsive to the stored head shape information, to form a first interconnecting head lying generally in a plane perpendicular to the first coil; and (d) repeating step (b) to thereby form a second coil in the wire parallel to the first coil, having a second orientation opposite the first orientation, and interconnected with the first coil by the interconnecting head formed in step (c).

2. The method of claim 1 wherein, in step (c):

the head shape electrical control signal is generated by modifying the coil radius control signal and the coil pitch control signal in response to the stored head shape information; and the wire guiding step is responsive to the modified coil radius and pitch control signals.

3. The method of claim 1 wherein the coil radius control signal generating substep of step (b) further includes:

producing a coil radius reference signal representative of the programmed radius of the coil to be formed;

sensing a coil radius parameter representative of the actual radius of the coil being formed and generating a coil radius monitoring signal in response to the sensed coil radius parameter; and comparing the radius reference signal and the radius monitoring signal and generating a radius error signal as a result of the comparison;

the fed wire forming step being responsive to the radius error signal.

4. The method of claim 1 wherein the coil pitch control signal generating substep of step (b) further includes:

producing a coil pitch reference signal representative of the programmed pitch of the coil to be formed;

sensing a coil pitch parameter representative of the actual pitch of the coil being formed and generating a coil pitch monitoring signal in response to the sensed coil pitch parameter; and comparing the pitch reference signal and the pitch monitoring signal and generating a pitch error signal as a result of the comparison;

the fed wire forming step being responsive to the pitch error signal.

5. The method of claim 1 further comprising the step of:

varying the coil radius electrical control signal as the wire is fed.

6. The method of claim 1 further comprising the step of:

varying the coil pitch electrical control signal as the wire is fed.

7. The method of claim 1 further comprising the steps of:

storing the spring head shape information in a spring head shape program that is a function of the feeding of the wire;

generating the spring head shape electrical control signal in response to the stored spring head shape program.

8. The method of claim 2 further comprising the steps of:

storing the coil head shape information in a program that is a function of the feeding of the wire;

modifying the coil radius and coil pitch electrical control signals in response to the program; and varying the coil radius and coil pitch electrical control signals as the wire is fed in response to the modified coil radius and coil pitch electrical control signals.

9. The method of claim 2 wherein, in step (c):

varying the coil radius and pitch control signals while the wire is being fed.

10. The method of claim 2 further comprising the steps of:

monitoring the shape of the interconnecting head formed in step (c) and generating a head shape monitoring signal in response thereto;

following step (d), further modifying the coil radius control signal and the coil pitch control signal in response to the monitoring signal; and repeating step (c) to form a second interconnecting head in response to the further modified coil radius and pitch control signals to form a second interconnecting head lying generally in a plane generally perpendicular to the first and second coils and generally parallel to the first interconnecting head.

11. The method of claim 10 wherein:

the monitoring step includes the step of generating a pictorial image of the first head; and resolving the pictorial image to produce the monitoring signal responsive to the actual shape of the first head.

12. An apparatus for forming a continuous multiple coil spring having a plurality of alternately oppositely oriented coils joined by interconnecting heads from wire comprising:

a machine housing;

a wire forming device mounted on the housing;

means on said housing for feeding wire longitudinally to the forming device at a linear rate;

means for storing spring head shape information related to a programmed shape of a head to be formed interconnecting an adjacent pair of coils to be formed of a wire, and for generating a spring head shape signal, in response to the stored information, representative of the shape of the interconnecting heads to be formed;

a spring head shape sensor for monitoring the shape of a spring head formed by the forming device and generating a monitoring signal in response thereto; and the forming device including a servo amplifier having inputs connected to the spring head shape signal generating means and the sensor and operable to compare a the spring head shape signal and the monitoring signal, and to generate an error signal as a result of the comparison, and means, responsive to a spring head shape signal and the error signal for bending the wire fed thereto to form an interconnecting head of the programmed shape between two adjacent coils.

13. The apparatus of claim 12 further comprising:

means responsive to the stored head shape information and the monitoring signals for communicating the spring head shape signal and error signal to the forming device in the form of a spring radius signal and a spring pitch signal; and the forming device includes at least two servo amplifiers, one responsive to the spring radius signal to cause the bending means to bend the wire in a first direction transverse the longitudinal direction of feed and one responsive to the spring pitch signal to cause the bending means to bend the wire transverse to the longitudinal direction of feed and the first direction.

14. The apparatus of claim 12 wherein:

the monitoring means includes means for forming a pictorial image of a formed spring head, and means included for deriving the monitoring signal from the pictorial image.

15. A method of forming springs comprising the steps of:

(a) storing spring shape information related to a programmed shape of spring lengths to be formed of a wire;

(b) feeding wire at a controlled linear rate, and, while so feeding the wire:

generating a curvature electrical control signal related to a programmed curvature to be formed in the wire, generating a pitch electrical control signal related to a programmed pitch to be formed in the wire, varying at least one of the electrical control signals to produce a programmed shape that varies as a function of the feeding of the wire, and bending the wire to the programmed curvature in response to the curvature electrical control signal and to a programmed pitch in response to the pitch electrical control signal, thereby forming a first spring length in accordance with the programmed shape;

(c) monitoring the shape of the formed first spring length and generating a shape monitoring signal in response thereto, the monitoring step including the steps of generating a pictorial image of the formed first spring length and resolving the pictorial image to produce the monitoring signal responsive to the actual shape of the formed first spring length;

(d) modifying at least one of the electrical control signals in response to the monitoring signal; and (e) repeating step (b) to form a second spring length in response to the electrical control signals so modified to form a second spring length.

16. The method of claim 15 wherein:

the wire bending step includes the step of forming the fed wire into an interconnecting head of the programmed shape formed of a length of the wire extending perpendicular to and joining two spring coils formed of the wire.

17. The method of claim 15 wherein:

the wire bending step includes the step of forming the fed wire into an interconnecting head of the programmed shape formed of a length of the wire extending perpendicular to and joining two parallel and oppositely oriented spring coils formed of the wire.

18. The method of claim 17 wherein:

both the wire curvature and wire pitch control signals vary in accordance with the stored spring shape information while the wire is being fed;

the interconnected head forming step includes the step of bending at least a portion of the wire to form at least a portion of the spring length to include at least one generally straight section joined to a curved section of varying radius, the portions generally lying in a plane.

19. The method of claim 15 wherein:

both the wire curvature and wire pitch control signals vary in accordance with the stored spring shape information while the wire is being fed;

the wire bending step includes the step of bending at least a portion of the wire to form at least a portion of the spring length to include at least one generally straight section joined to a curved section of varying radius, the portions generally lying in a plane.

20. The method of claim 15 further comprising the steps of:

producing a curvature reference signal and a pitch reference signal in response to the stored spring shape information;

the monitoring step including the step of photometrically forming a first pictorial image of the formed first spring length in a first plane and generating a curvature monitoring signal therefrom, and photometrically forming a second pictorial image of the formed first spring length in a second plane perpendicular to the first plane and generating a pitch monitoring signal therefrom; and the electrical control signal modifying step including the steps of comparing the curvature reference signal and the curvature monitoring signal and generating a curvature error signal thereby, comparing the pitch reference signal and the pitch monitoring signal and generating a pitch error signal thereby, and generating modified curvature and pitch electrical control signals in accordance with the respective curvature and pitch error signals.

21. A method of forming springs comprising the steps of:

(a) providing a plurality of spring forming machines each controlled to operate simultaneously to produce springs of the same shape in accordance with a plurality of machine parameter settings of the respective machine;

(b) centrally storing digitized spring shape reference data containing information related to a programmed shape of spring lengths to be formed by each of the machines;

(c) operating each of the machines to produce springs in accordance with the spring parameter settings of the respective machine;

(d) monitoring springs produced by each of the machines and generating multidimensional spring shape data of the shape of the monitored springs;

(e) selecting one of the machines of the plurality of machines;

(f) separately comparing, with the spring shape reference data, the generated data of the shape of a spring produced by the selected one of the machines and generating a comparison signal carrying information of the existence of a dimensional discrepancy in the spring produced by the selected machine;

(g) digitally analyzing information derived from the multidimensional data of the shape of the spring produced by the selected machine and the comparison signal;

(h) digitally deriving from the analysis of step (g) at least one adjustment signal that will tend to correct a discrepancy determined to exist in the spring produced by the selected machine;

(i) adjusting at least one parameter of the selected machine in response to the adjustment signal; and (j) repeating steps (c) through (i).

22. The method of claim 21 wherein:

the step of repeating step (e) includes the step of selecting the machine in response to information derived from multidimensional data of the shapes of springs produced by the machines and a previously generated comparison signal carrying information of the existence of a dimensional discrepancy.

23. The method of claim 21 further comprising the steps of:

establishing, in response to the existence of a dimensional discrepancy in a spring produced by a selected machine, a selection schedule increasing selection frequency of the selected machine; and, the step of repeating step (e) including the step of selecting the machine in accordance with the established selection schedule.

24. The method of claim 21 further comprising the steps of:

testing the discrepancy against a criterium and producing an alarm indication in response to results of the testing.

25. The method of claim 21 further comprising the steps of:

testing the discrepancy against a maximum discrepancy criterium and producing an alarm indication when the discrepancy exceeds the criterium.

26. The method of claim 21 wherein:

the step of digitally analyzing information derived from the multidimensional data of the shape of the spring produced by the selected machine and the comparison signal includes the step of correlating the analyzed information with data associated with a cause of discrepancies and generating an output signal carrying information for correction of the cause.

* * * * *